United States Patent [19]

Samuelsson

[11] Patent Number: 4,611,363

[45] Date of Patent: Sep. 16, 1986

[54] SQUEEGEE HOLDING APPARATUS

[76] Inventor: Soren Samuelsson, 74-259 Candlewood St., Palm Desert, Calif. 92260

[21] Appl. No.: 732,931

[22] Filed: May 13, 1985

[51] Int. Cl.[4] ..... A47L 1/06

[52] U.S. Cl. ..... 15/245

[58] Field of Search ..... 15/245, 117, 121, 169

[56] References Cited

U.S. PATENT DOCUMENTS

| | | | |
|---|---|---|---|
| 911,194 | 2/1909 | Bailey | 15/245 |
| 948,631 | 2/1910 | Lane | 15/245 |
| 1,628,783 | 5/1927 | Jensen et al. | 15/245 |
| 1,706,053 | 3/1929 | Bussinger | 15/245 |
| 1,840,023 | 1/1932 | Couture | 15/121 X |
| 2,103,198 | 12/1937 | Siemund | 15/245 |
| 2,207,651 | 7/1940 | Batchelder | 15/245 |
| 2,261,475 | 11/1941 | Kautenberg | 15/245 |
| 2,307,460 | 1/1943 | Greisen | 24/255 |
| 2,440,099 | 4/1948 | Kind | 15/245 |
| 3,013,290 | 12/1961 | Soito | 15/245 |
| 3,787,921 | 1/1974 | Feldmann | 15/105 |
| 3,950,813 | 4/1976 | Buck | 15/245 |

FOREIGN PATENT DOCUMENTS

| | | | |
|---|---|---|---|
| 558657 | 8/1923 | France | 15/245 |
| 572388 | 6/1924 | France | 15/245 |

*Primary Examiner*—Chris K. Moore

*Attorney, Agent, or Firm*—Fulwider, Patton, Rieber, Lee & Utecht

[57] ABSTRACT

A channel-shaped holder having parallel side walls which cooperate to form a cavity therebetween for receiving a cleaning blade. One edge of the cleaning blade is mounted in an elongated channel-shaped cap which includes an elongated slider protruding from one side thereof. The slider is inserted into a selected one of a number of longitudinally-elongated, parallel, laterally spaced apart grooves formed on the interior of the holder to selectively adjust the distance the free edge of such blade projects from the holder.

10 Claims, 5 Drawing Figures

FIG. 1
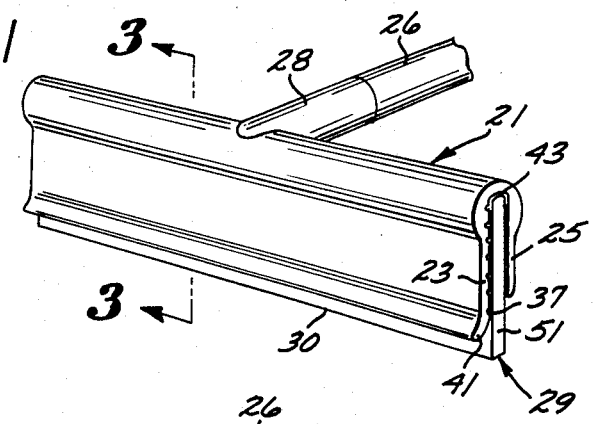
FIG. 5
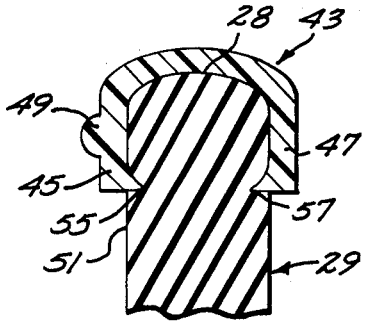
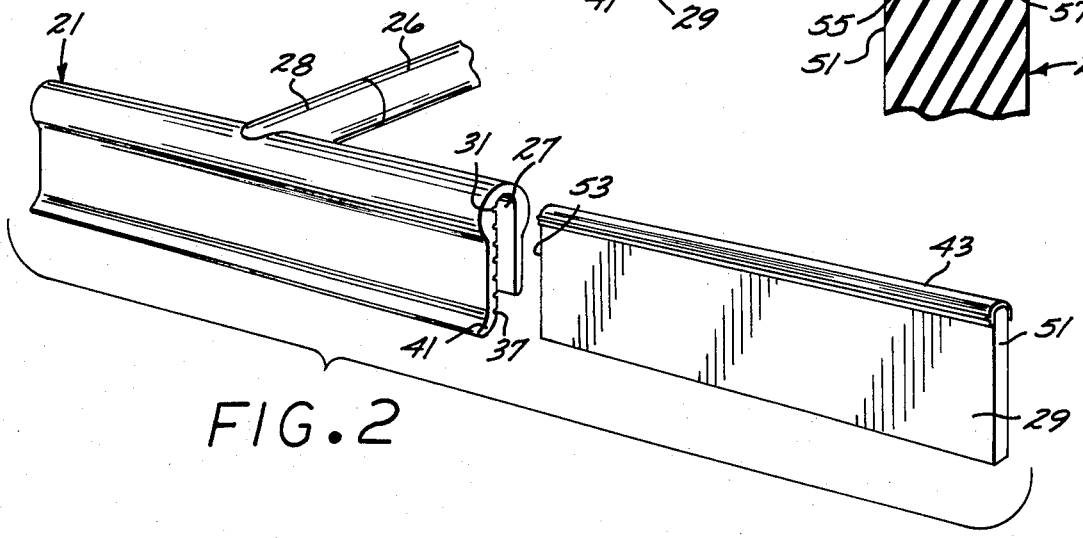
FIG. 2
FIG. 3
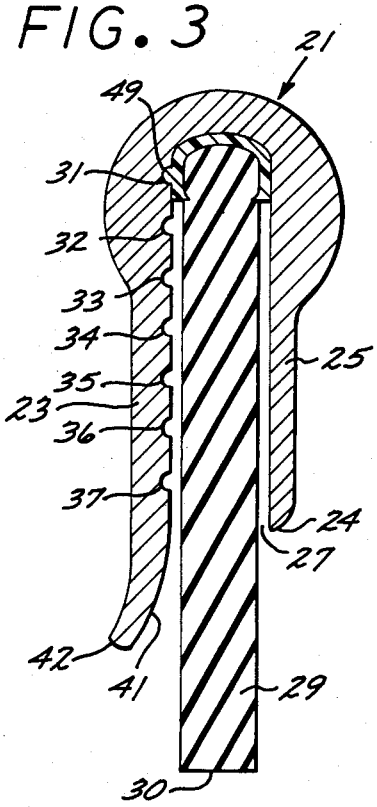
FIG. 4
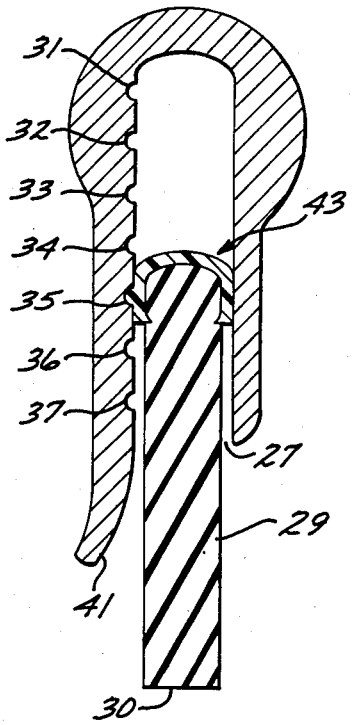

SQUEEGEE HOLDING APPARATUS

BACKGROUND OF THE INVENTION

1. Field of the Invention

The present invention relates generally to hand operated cleaning tools, commonly known as squeegees.

2. Description of the Prior Art

A long standing need has existed for a squeegee holding apparatus which permits utilization of the entire width of the cleaning blade after the initial working edge thereof has deteriorated due to use. It is desirable to provide for selective lateral adjustment of the blade within a holder while securely retaining it during use. Various squeegee holders have been proposed to utilize more of the cleaning blade than the initial edge projecting from the holder.

Kautenberg, U.S. Pat. No. 2,261,475, proposes a solution whereby the cleaning element or blade may be reversed in its holder so that the opposite edge of the blade may be used when the initial working edge deteriorates. However, such a device, while satisfactory for its intended purpose, it is limited in that it provides only one additional cleaning surface after the initial edge becomes worn. Additionally, this cleaner requires a blade which is custom made with a plurality of ribs formed integrally therein.

Jensen, U.S. Pat. No. 1,628,783, also provides a squeegee holder in which the cleaning element can be removed and reversed when the initial edge of the cleaning blade becomes worn. Both Jensen and Kautenberg employ rather elaborate clamping mechanisms which are expensive to manufacture and present a risk of insecure clamping of the blade. The blade employed in the Jensen squeegee, like Kautenberg, employes a unique ribbed configuration which adds to the expense of manufacture.

U.S. Pat. No. 2,440,099 to Kind shows a squeegee holder which permits adjustment of the blade position within the holder. Kind utilizes clamping jaws controlled by the handle position which is screwed into a threaded opening and exerts end pressure against a spring abutting the clamping jaws. Such a device, while satisfactory for some applications, fails to provide for positive clamping of the blade against edgewise movement or for gauging the magnitude of blade projection.

SUMMARY OF THE INVENTION

A squeegee holding apparatus in which the position of the cleaning element may be incrementally adjusted within the holder to project the working edge thereof predetermined distances therefrom such that the working edge, when deteriorated, may be trimmed to form a new, well defined edge which may then be projected the predetermined distance. It is the major object of the present invention to provide a squeegee holding apparatus without utilizing bolts or clamps and which is more convenient to use, while providing a means to selectively adjust and securely retain the cleaning blade within the holder such that the worn edge of the cleaning blade may be trimmed to produce a new cleaning edge. It is a major object of the present invention to provide a squeegee holder which may be universally utilized with any type of flexible cleaning blade including a rectangular one without specially formed ribs.

The squeegee holding apparatus of the present invention is characterized by an elongated, rigid, channel-shaped holder formed with a pair of spaced-apart parallel side walls. The side walls define therebetween an interior cavity for receiving a flexible squeegee cleaning blade. At least one of the side walls is formed in its interior face with laterally spaced-apart, elongated grooves and terminates in a support edge extending parallel to such grooves. A removable channel-shaped cap is fitted around one edge of the squeegee cleaning blade. The cap is formed on its exterior with a protruding slider for slidable receipt in a selected groove of the holder. Consequently, as the projecting working edge of the blade becomes worn it may be progressively cut back, or trimmed, and the blade moved progressively selected distances forward in the holder by progressively shifting the cap toward the support edge of the holder as dictated by receipt of the slider in grooves spaced closer to such edge.

Other objects and features of the invention will become apparent from consideration of the following description taken in connection with the accompanying drawings.

BRIEF DESCRIPTION OF THE DRAWINGS

FIG. 1 is a perspective view of a squeegee holding apparatus with a squeegee cleaning blade inserted;

FIG. 2 is a perspective view of a squeegee holding apparatus with a squeegee cleaning blade removed from the holder;

FIG. 3 is a transverse sectional view, in enlarged scale, taken along the line 3—3 of FIG. 1;

FIG. 4 is a transverse sectional view similar to FIG. 3; and

FIG. 5 is a broken transverse, sectional view in enlarged scale, of the blade shown in FIG. 4.

DESCRIPTION OF THE PREFERRED EMBODIMENT

Referring to FIGS. 1–3, the squeegee holding apparatus of the present invention includes, generally, a channel-shaped holder 21 formed interiorly with a plurality of coextensive, inwardly opening grooves 31–37. A flexible squeegee blade, generally designated 30, has one edge capped by a channel shaped cap, generally designated 43, which is configured to closely fit within the holder 21. The cap 43 is formed on one side with an elongated rib defining a slider 35 for slidable receipt in selected ones of the grooves 31–37 to selectively shift the blade 29 toward the open side of the holder 21 to project the working edge 30 therefrom to a degree dictated by the groove selected.

The holder 21 may be constructed of any desirable material such as aluminum or hard plastic and is U-shaped in cross section to form a pair of elongated, rigid, spaced-apart, parallel side walls 23 and 25 which cooperate to define an interior cavity 27, as best seen in FIG. 2, for receiving the squeegee cleaning blade 29. A conventional handle 26, is received in a boss 28 which projects laterally from the holder 21. The side wall 23 is formed on its interior with a plurality of longitudinally-elongated extending, laterally spaced-apart, parallel tracks or grooves 31 through 37 as best seen in FIG. 3. Such side wall 23 projects beyond the plane of the edge 24 of the opposite wall 25 and terminates in a longitudinally-elongated, out-turned, slightly arcuate pusher lip 41 which terminates in support edge 42 coextensive with grooves 31 through 37.

The blade 29 is rectangular and formed along one side with a capped edge 28 and along the opposite side with the working edge 30.

The cap 43 may also be constructed of, for instance aluminum or hard plastic, and is formed to closely fit over and retain the squeegee blade edge 28.

Referring to FIG. 5, the cap 43 is channel shaped to form opposed side walls 45 and 47 which embrace the opposite sides of the blade 29. The laterally opposite faces of the walls 45 and 47 are spaced apart a distance to closely fit within the inside faces of the walls 23 and 25 of the holder 21 to thus hold the cap 43 firmly against lateral movement. In a preferred embodiment, the lower extremities of the walls 45 and 47 are formed with in-turned, longitudinal lips 55 and 57 for penetrating into the opposite sides of the flexible blade.

In operation, it will be appreciated that the cap 43 and the retained squeegee blade 29 may be fabricated as a unit. Such unit may be inserted in endwise in the cavity 27 of the holder with the slider 49 slid into the groove 31 farthest recessed from the support edge 42 as shown in FIG. 3. The holder 21 may then be utilized by a workman to squeegee, for instance, the surface of a window (not shown). The handle 26 may be grasped and the holder pressed toward the work surface while the holder is drawn in the direction of the handle (FIG. 1). The frictional resistance against the work edge 30 of the blade 29 contacted against the work surface will cause the portion of the blade projecting from the cavity 27 to bend back and follow the inside contour of the pusher lip 41 to the point where it will be laid back over the support edge 42.

Continued use of the apparatus in this manner over a period of time will cause the work edge 30 to become worn, damaged and irregular over the length thereof thus rendering it ineffective as a cleaning edge and resulting in the blade 29 leaving streaks and smudges on the work surface. When the working edge 30 of cleaning blade 29 becomes worn as to be ineffective, cap 43 and retained blade 29 may be removed from the holder by pushing endwise thereon, causing the slide 49 to glide through its groove until the cap and blade are ejected from the holder. The edge 30 of the blade 29 may then be trimmed along a straight edge to form a new well defined, even working edge. The cap and blade may then be reinserted in the holder with the slider 31 recessed in the groove 32 closer to lip 41 than the groove 31 to thus project the new working edge 30 of the cleaning blade a distance beyond the support edge 41 to enable the new edge to function as described above. It will therefore be appreciated that this procedure may be repeated by advancing the blade laterally from groove 32 to groove 33 and so on as needed.

Projection of the side wall 23 beyond the plane of the edge 24 of the side wall 25 to form the lip 41 as shown in FIG. 3 enables the wall 25 to lead the wall 23 as the holder is drawn over the work surface such that the turned back lip 41 serves as a support behind the blade 29 to afford a gradual transition for the blade to lay back thereagainst.

Various modifications and changes may be made with respect to the foregoing description without departing from the spirit of the present invention. For example, the side walls 23 and 25 and cap may be symmetrical rather than asymmetrical. Side walls 23 and 25 may be interiorly formed with diametrically-opposed grooves and cap 43 formed with corresponding diametrically opposed sliders.

From the foregoing, it will be apparent that the squeegee holding apparatus of the present invention provides a holder which is inexpensive to manufacture, employs a minimum number of components and is convenient to use. The arrangement for advancing the cleaning blade may be utilized with a variety of blades and will accommodate a common plane blade while providing for positive location of the trimmed blade without slippage or shifting.

I claim:

1. A squeegee holding apparatus comprising:

an elongated, rigid, channel-shaped holder formed with spaced-apart, first and second parallel sidewalls cooperating to define therebetween an interior cavity, said first sidewall terminating in an elongated lip and being formed on its interior with a plurality of laterally spaced apart, parallel grooves co-extensive with said lip;

a flexible squeegee blade formed with oppositely disposed first and second edges;

a removable channel-shaped cap for slidable receipt within said cavity and formed with laterally spaced-apart walls for embracing said first edge of said blade; and a slider positioned on the exterior of said cap and formed for selective, slidable receipt in said grooves and cooperating with said cap to removably hold said blade in said holder whereby said cap may be selectively inserted in said cavity with said slider received in selected ones of said grooves, thereby varying the distance said second edge of said blade projects beyond said lip.

2. The squeegee holding apparatus of claim 1 wherein:

said cap is formed with a pair of side walls including gripping means for gripping the opposite sides of said blade.

3. The squeegee holding apparatus of claim 2 wherein:

said gripping means comprises inwardly projecting lips formed on each opposing wall of said cap for gripping the blade.

4. The squeegee holding apparatus of claim 2 wherein:

said second side wall terminates in an edge and said first side wall projects beyond the plane of said edge of said second side wall to form a pusher lip.

5. The squeegee holding apparatus of claim 2 wherein:

said slider is in the form of a rib projecting the length of said cap.

6. The squeegee holding apparatus of claim 2 wherein:

said cap is formed with oppositely facing lateral faces, spaced apart a distance to closely fit in said cavity between the inside faces of said first and second walls of said holder.

7. The squeegee holding apparatus of claim 1 wherein:

said second side wall terminates in an edge and said first side wall projects beyond the plane of said edge of said second side wall to form a pusher lip.

8. The squeegee holding apparatus of claim 1 wherein:

said slider is in the form of a rib projecting the length of said cap.

9. The squeegee holding apparatus of claim 1 wherein:

said cap is formed with oppositely facing lateral faces, spaced apart a distance to closely fit in said cavity between the inside faces of said first and second walls of said holder.

10. The squeegee holding apparatus of claim 1 wherein:

said holder includes a laterally projecting handle-receiving boss.

* * * * *